US007293668B2

(12) United States Patent
Brossart et al.

(10) Patent No.: US 7,293,668 B2
(45) Date of Patent: Nov. 13, 2007

(54) MANUAL BOOM LIFT METHOD AND APPARATUS

(75) Inventors: Ray Brossart, Portland, OR (US); Dave Trammel, Clackamas, OR (US); Ken Klunder, Oregon City, OR (US)

(73) Assignee: KDR, LLC, Clackamas, OR (US)

( * ) Notice: Subject to any disclaimer, the term of this patent is extended or adjusted under 35 U.S.C. 154(b) by 1 day.

(21) Appl. No.: 11/048,684

(22) Filed: Feb. 1, 2005

(65) Prior Publication Data

US 2006/0169661 A1 Aug. 3, 2006

(51) Int. Cl.
*B66C 23/26* (2006.01)

(52) U.S. Cl. ..... 212/177; 212/175; 212/179

(58) Field of Classification Search ..... 212/195, 212/241, 249, 263, 175, 177, 179
See application file for complete search history.

(56) References Cited

U.S. PATENT DOCUMENTS

| | | | | | |
|---|---|---|---|---|---|
| 25,494 | A * | 9/1859 | Duchamp | 212/263 |
| 514,355 | A * | 2/1894 | French | 212/241 |
| 709,506 | A * | 9/1902 | Packer | 212/241 |
| 1,316,181 | A * | 9/1919 | Phares | 212/195 |
| 1,345,008 | A * | 6/1920 | Hill | 212/177 |
| 2,377,758 | A * | 6/1945 | Cohen | 212/179 |
| 3,240,353 | A * | 3/1966 | Leavesley | 212/279 |
| 3,268,092 | A * | 8/1966 | Hainer et al. | 414/729 |
| 4,004,778 | A * | 1/1977 | Steinhagen | 212/294 |
| 4,310,098 | A * | 1/1982 | Dirksen | 212/299 |
| 4,671,478 | A * | 6/1987 | Schoenig et al. | 248/124.1 |
| 4,849,778 | A * | 7/1989 | Samuelson | 396/428 |
| 6,375,145 | B1 * | 4/2002 | Payne | 248/500 |
| 6,416,418 | B1 * | 7/2002 | Kleimeyer | 472/118 |
| 6,478,427 | B1 * | 11/2002 | Morris et al. | 352/243 |
| 6,705,773 | B2 * | 3/2004 | Fix | 396/419 |
| 6,910,846 | B1 * | 6/2005 | Doeden | 414/589 |
| 7,062,962 | B2 * | 6/2006 | Pasternack et al. | 73/170.29 |
| 2006/0043041 | A1 * | 3/2006 | Lopes | 212/175 |

OTHER PUBLICATIONS

Definition of the Term "Telescopic" From ANSWERS.COM Web Page; Page Dated Jun. 7, 2007.*

* cited by examiner

*Primary Examiner*—Thomas J. Brahan
(74) *Attorney, Agent, or Firm*—Ater Wynne LLP

(57) ABSTRACT

Manual boom lift apparatus and method involve a base having three support legs, a fulcrum configured to fixedly mount the legs, a boom member detachably mounted on the fulcrum, the boom member including on either end a counterbalance arm configured for detachably mounting one or more counterweights and a lift arm configured for hoisting a load, the lift apparatus enabling lift and placement of the load by pivotal manipulation of the boom member. Assembly of the detachable boom lift apparatus components is performed on the work site (in situ) and involves removably pinning aligned hole pairs to join the components and filling one or more containers with ballast to act as counterweights to the hoisted load. The apparatus is lightweight and durable, is easy to transport through small openings and can be used in rooftop installations of heating, ventilation, air conditioning and refrigeration (HVAC/R) equipment.

22 Claims, 6 Drawing Sheets

MANUAL BOOM LIFT METHOD AND APPARATUS

BACKGROUND OF THE INVENTION

Cranes are used for heavy lifting, but weigh several tons (since they typically use heavy counterweights) and typically are stationary, with a predefined range or so-called 'reach.' Some cranes are mounted on wheels, thus rendering them tow-able or even drivable, but they still suffer from the same weight and reach problems. Moreover, cranes are very expensive to own and operate. Forklifts have the same problems of high weight and cost, and suffer even more limited reach relative to their counterweighted base, but they are maneuverable. Neither cranes nor forklifts are lightweight and portable enough to be employed in rooftop installations.

Auto shop engine pullers use hoists, e.g. cable and pulley systems, or hydraulics to meet medium load lifting needs. They are generally fixed in position and do not break down easily for transporting to a different work site. Moreover, such an engine puller typically has a negative range, i.e. its effective lift range is within the perimeter of its base's footprint.

Rooftop installations, e.g. of heating/ventilation/air conditioning/refrigeration (HVAC/R), often require lifting of light to medium loads of less than approximately 1000 pounds. It is most often cost-prohibitive to do a rooftop installation or replacement, e.g. of an air conditioning unit, using a crane. A typical shop forklift weighs upwards of twelve tons, exceeding the load capacity of most rooftops. In any event, a crane would typically be required to lift the forklift onto the rooftop. Hydraulic/pneumatic lifts are heavy and difficult to transport. Moreover, a hydraulic/pneumatic lift requires power and/or a hydraulic/pneumatic source.

SUMMARY OF THE INVENTION

Manual boom lift apparatus and method involve a base having three support legs, a fulcrum configured to fixedly mount the legs, a boom member detachably mounted on the fulcrum, the boom member including on either end a counterbalance arm configured for detachably mounting one or more counterweights and a lift arm configured for hoisting a load, the lift apparatus enabling lift and placement of the load by pivotal manipulation of the boom member. Assembly of the detachable boom lift apparatus components is performed on site (in situ) and involves removably pinning aligned hole pairs to join the components and filling one or more containers with ballast to act as counterweights to the hoisted load. The apparatus is lightweight and durable, is easy to transport through small openings and can be used in rooftop installations of heating, ventilation, air conditioning and refrigeration (HVAC/R) equipment.

These and additional objects and advantages of the present invention will be more readily understood after consideration of the drawings and the detailed description of the preferred embodiment which follows.

Figure 1:
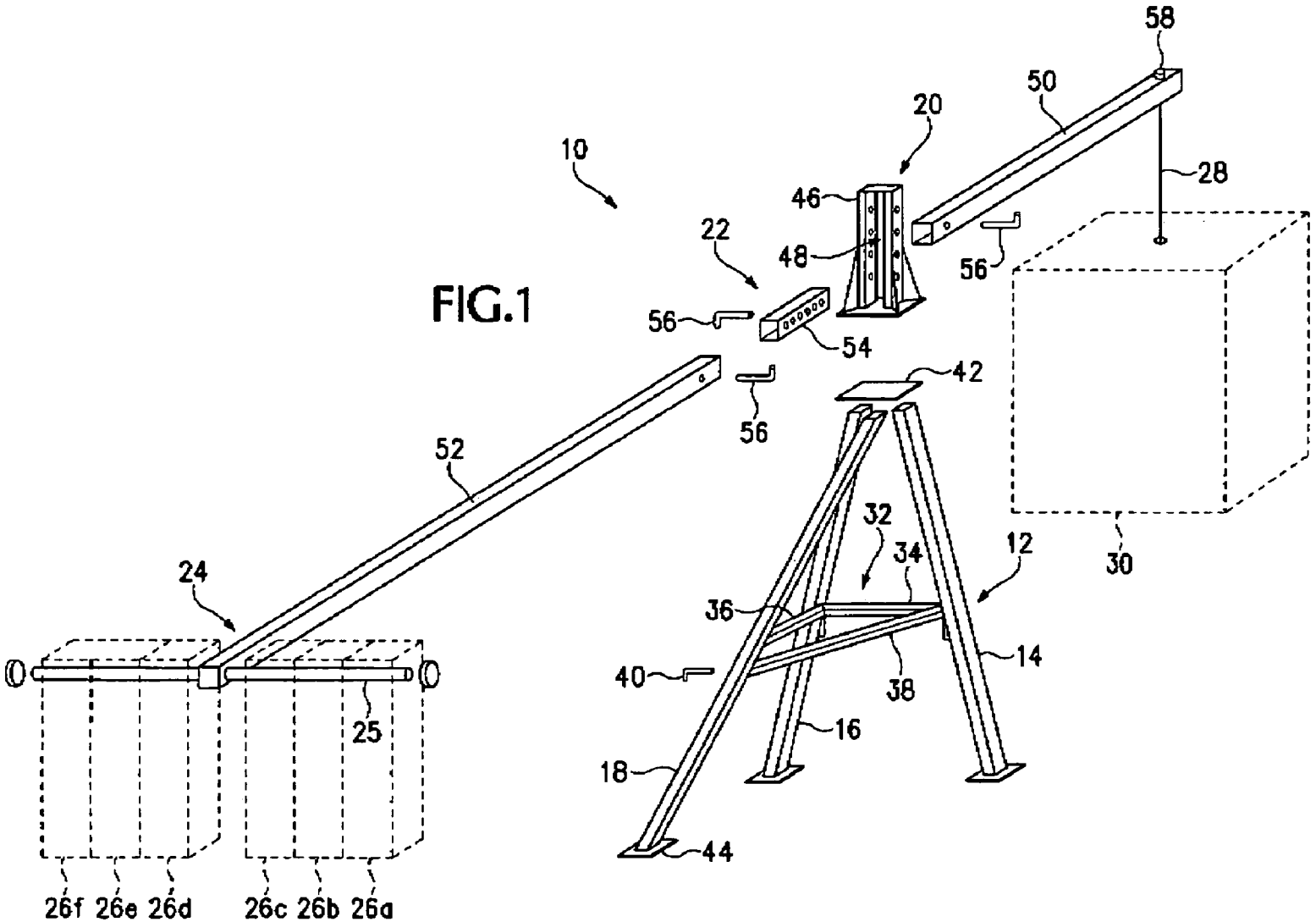
FIG. 1 is an isometric view in exploded assembly form of the invented apparatus in accordance with one embodiment of the invention, with the counterbalance weights shown only in phantom.

Detail A corresponds with FIG. 1, but shows in enlarged fragmentary, assembled, isometric view the fulcrum mechanism that forms a part of the invented apparatus in accordance with one embodiment of the invention.

Figure 2:
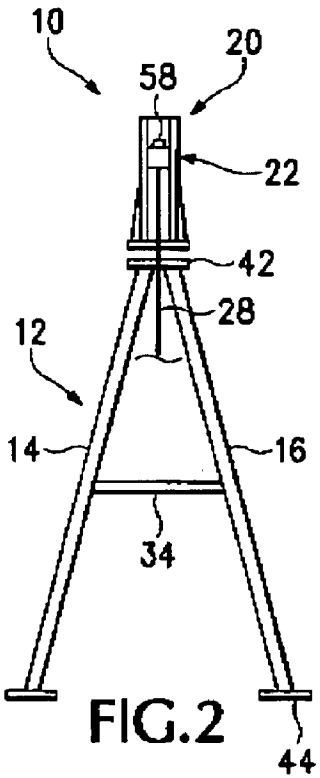

FIG. 2 is a front elevation corresponding with FIG. 1 but with the boom omitted for clarity.

Figure 3:
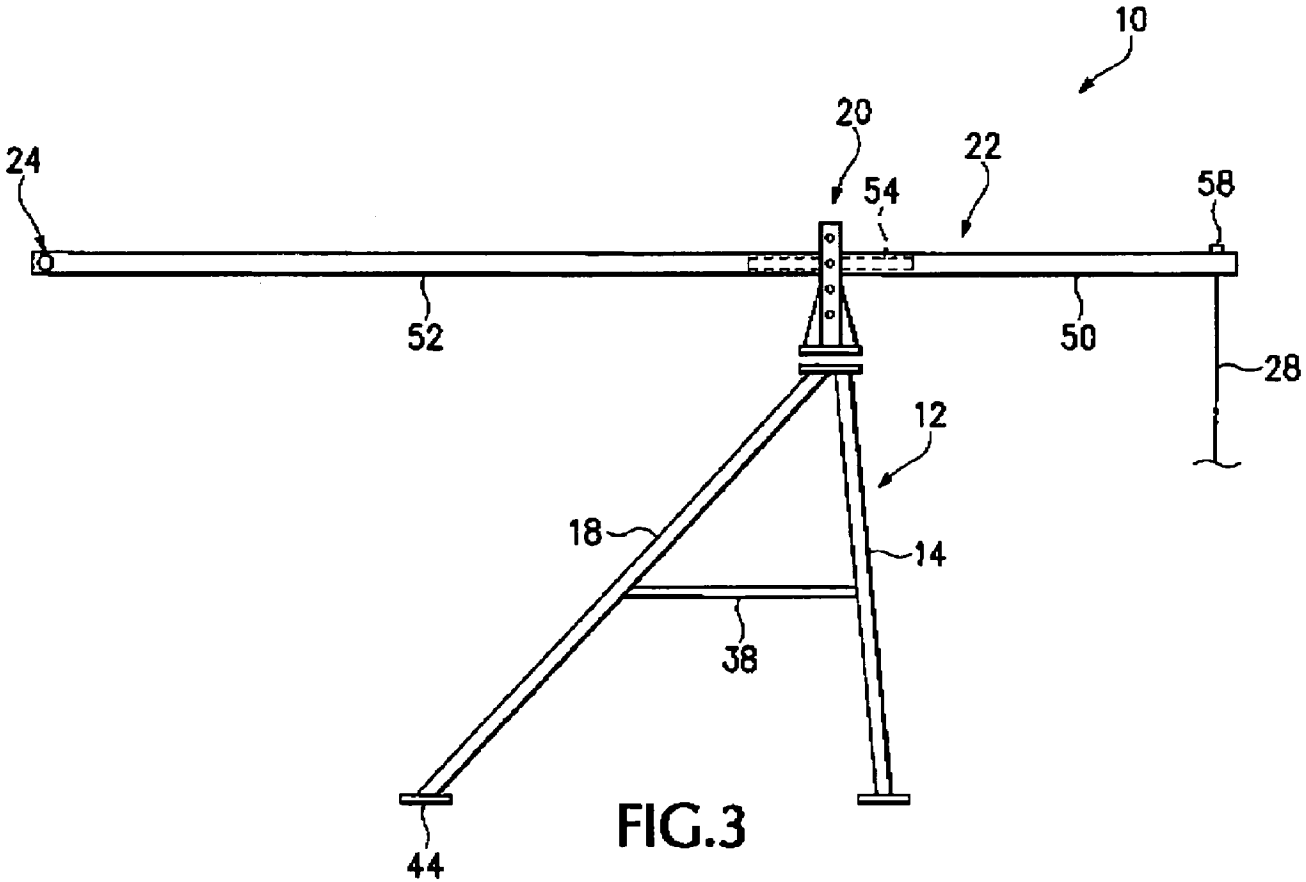

FIG. 3 is a side elevation corresponding with FIG. 2.

Figure 4:
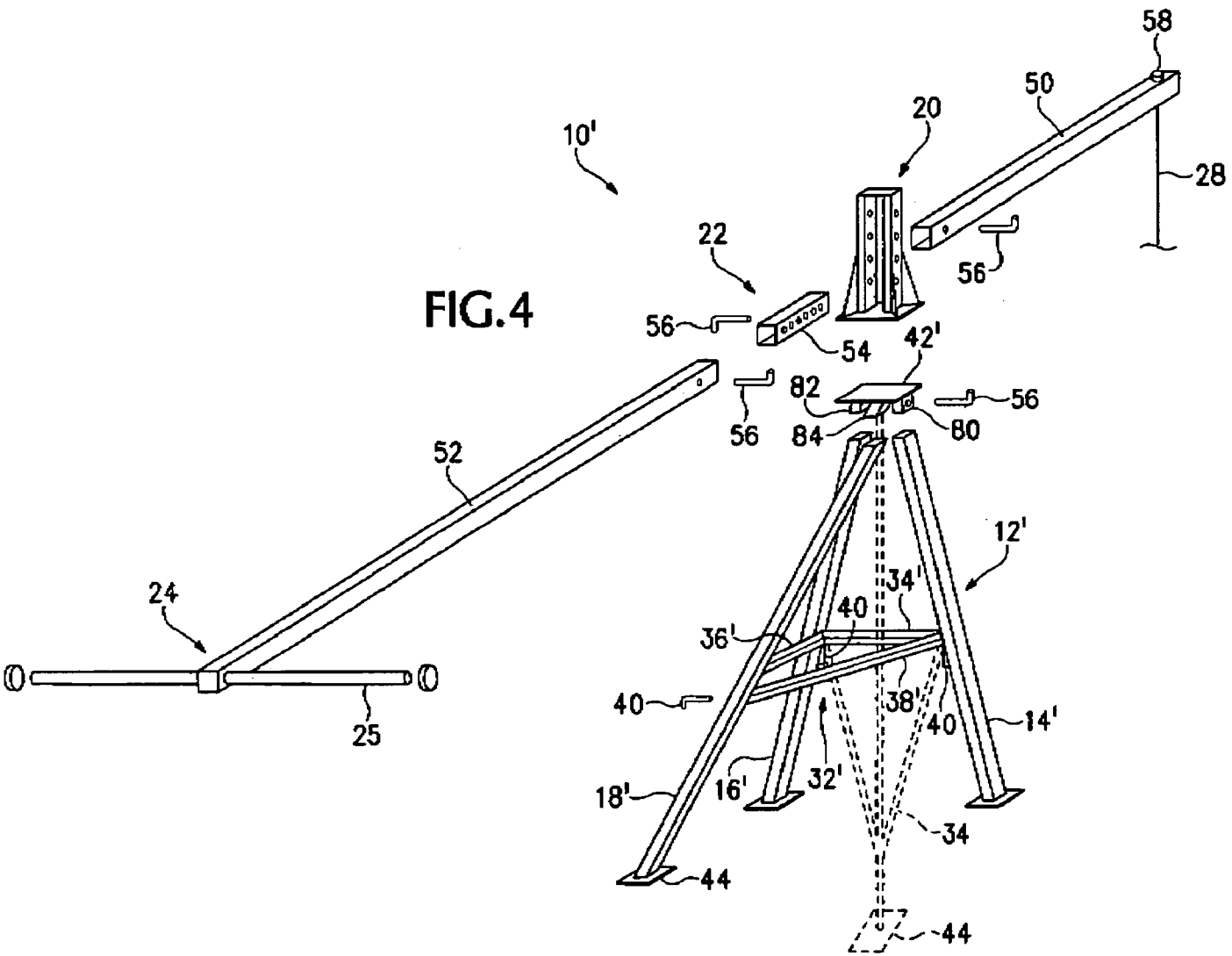

FIG. 4 is an isometric view in exploded assembly form of the invented apparatus in accordance with a second embodiment of the invention, with the counterbalance weights shown only in phantom.

Figure 5:
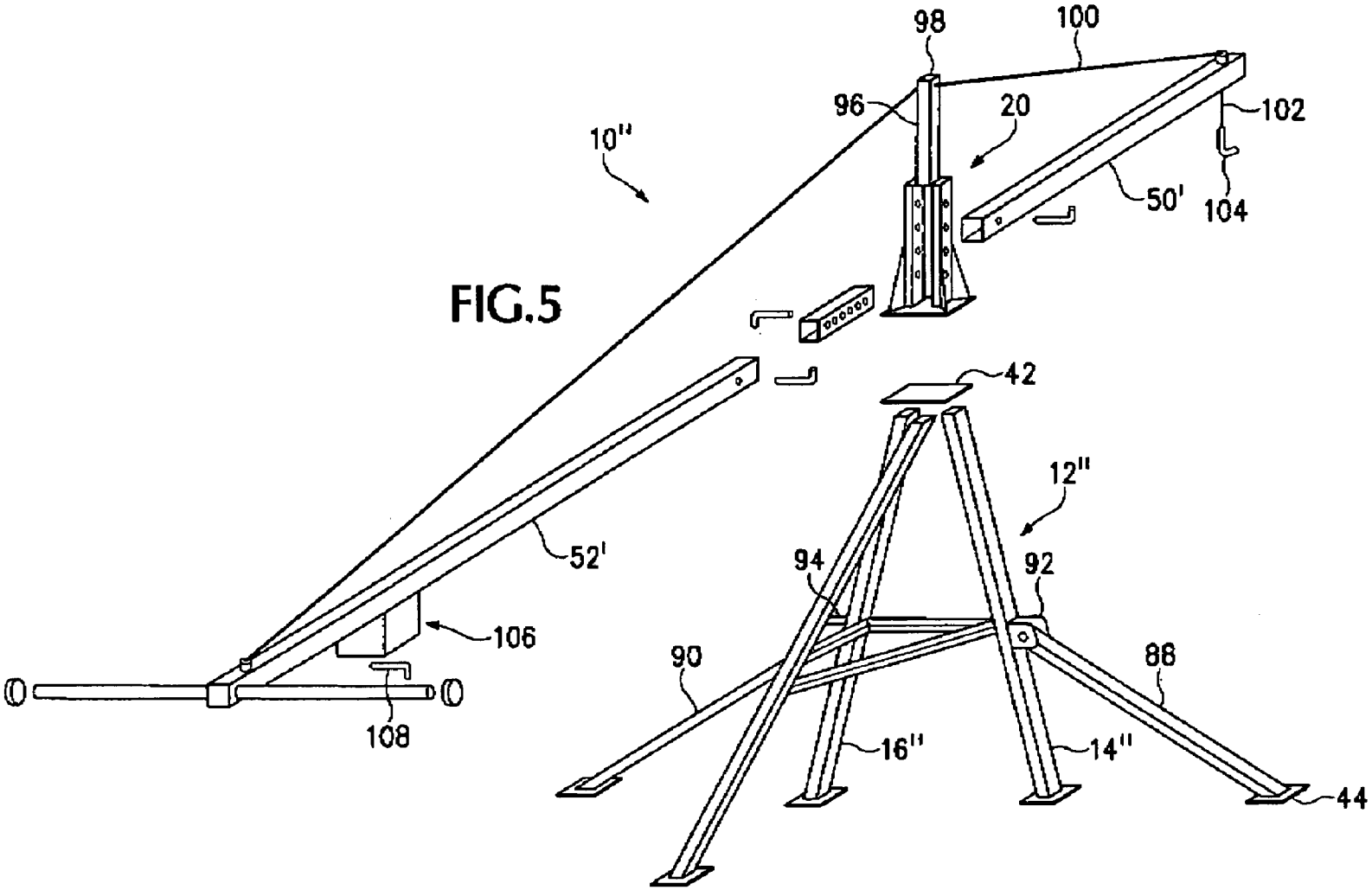

FIG. 5 is an isometric view in exploded assembly form of the invented apparatus in accordance with a third embodiment of the invention, with the counterbalance weights shown only in phantom.

Figure 6:
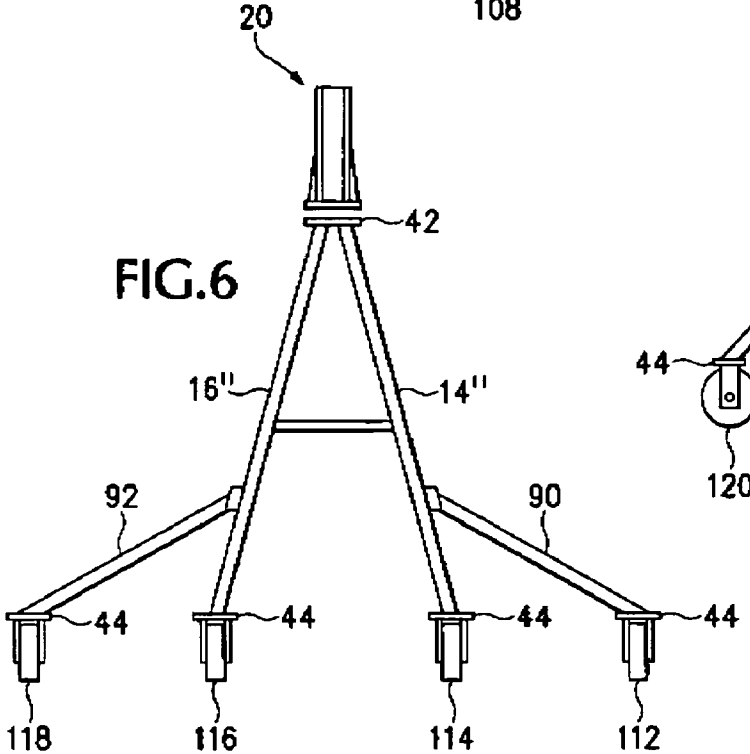

FIG. 6 is a front elevation corresponding with FIG. 5, with the boom omitted for clarity.

Figure 7:
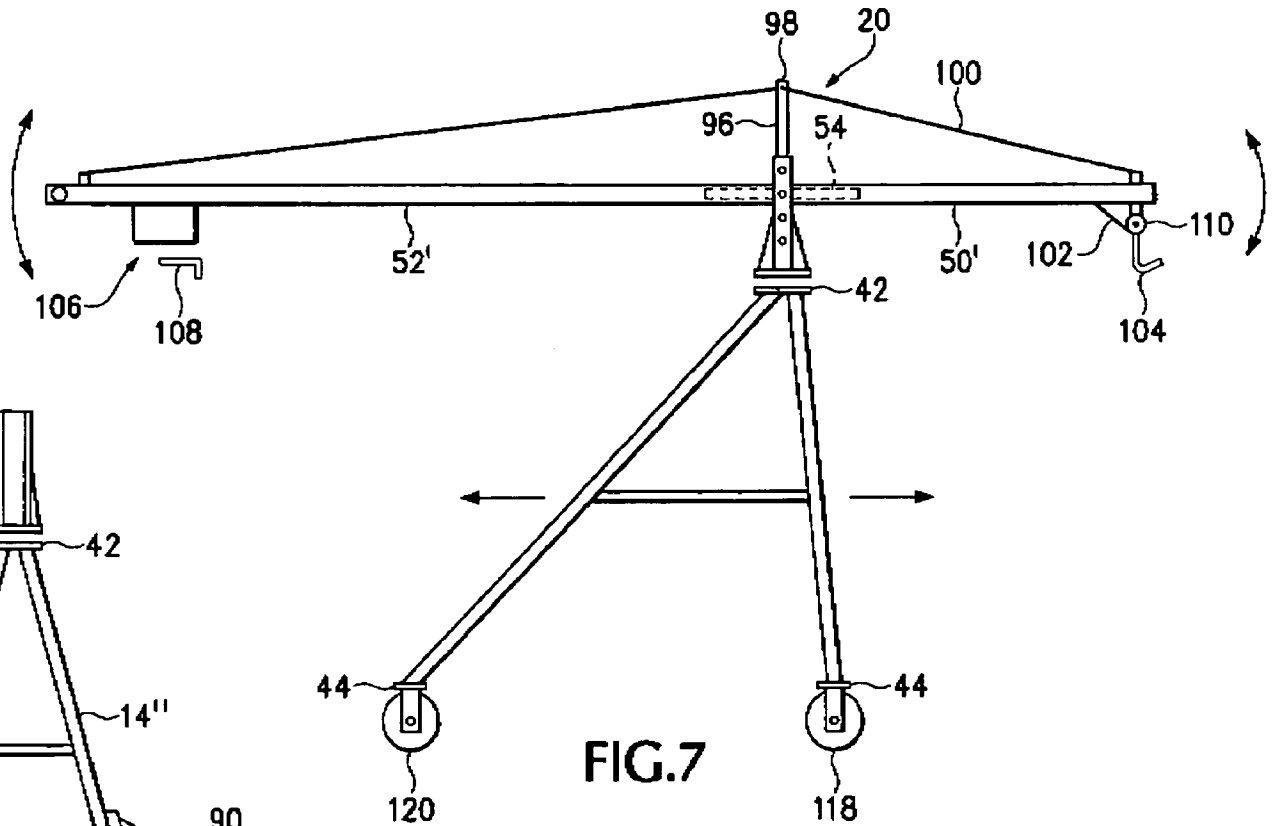

FIG. 7 is a side elevation corresponding with FIG. 5, but with the boom included, and with the counterbalance weights shown only in phantom.

Figure 8:
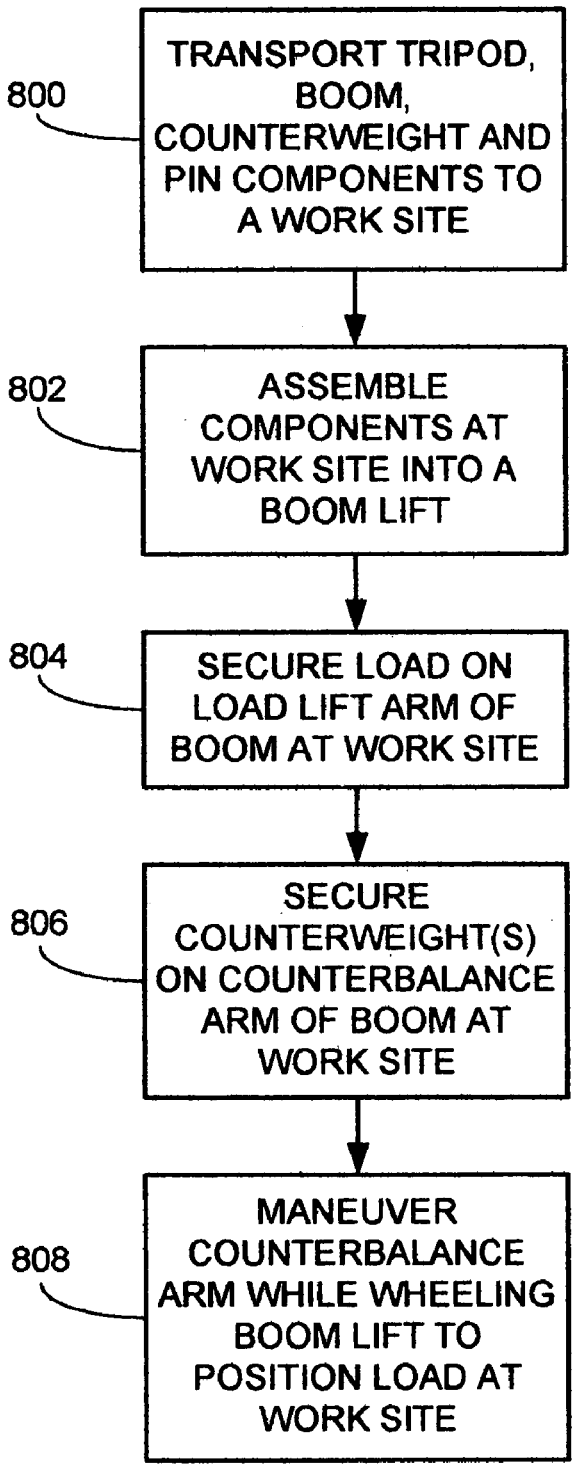
Figure 1:
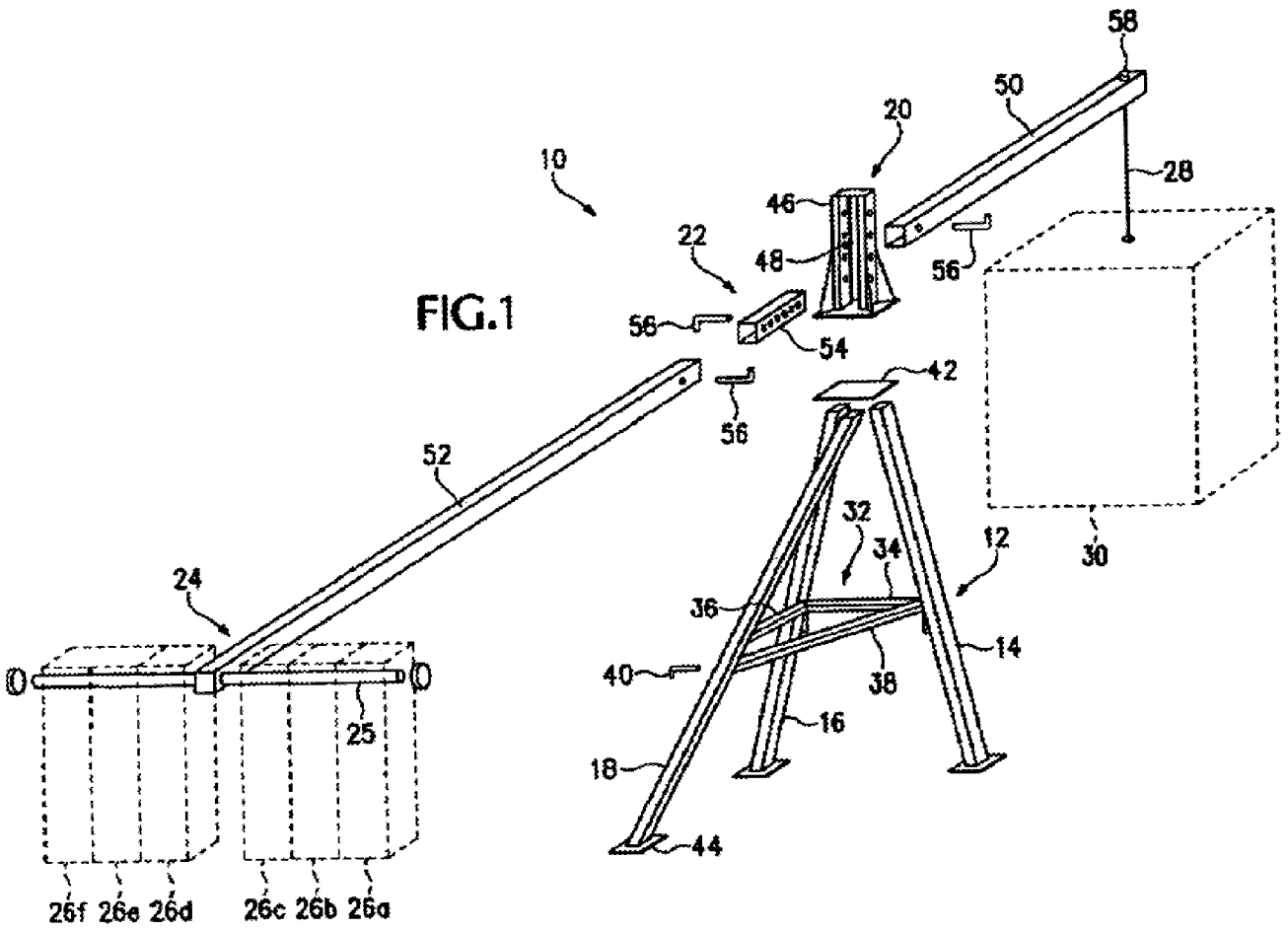
Figure 3:
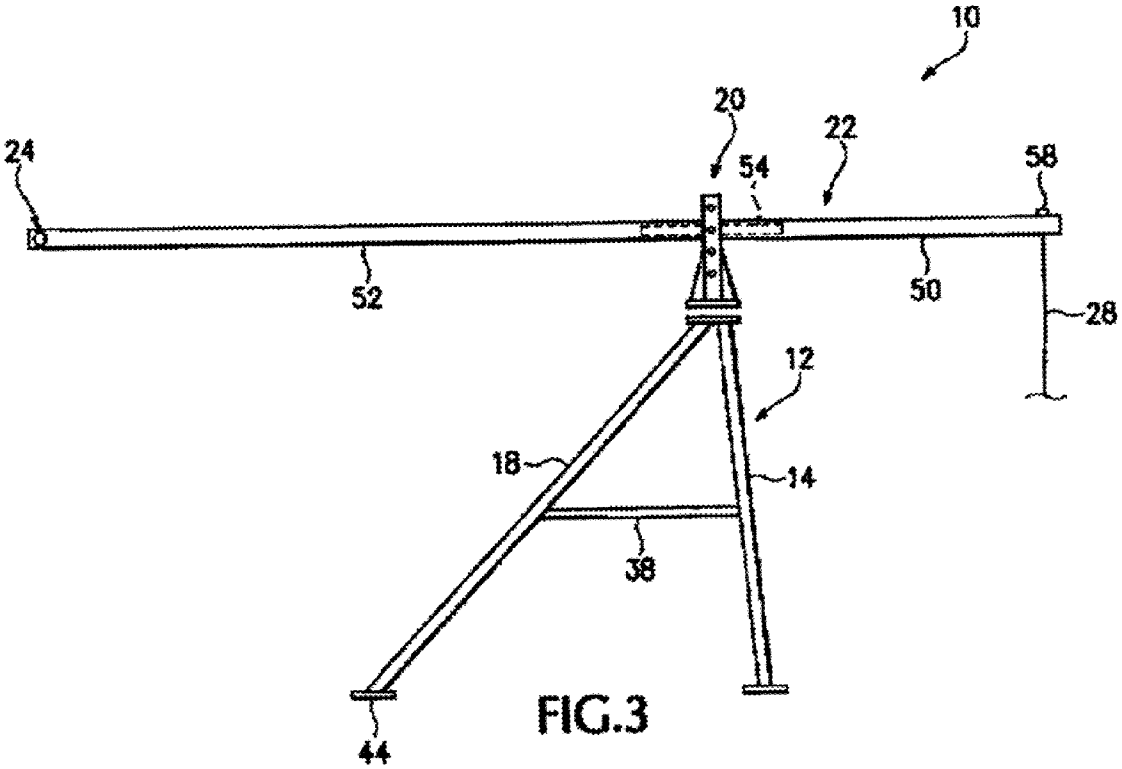
Figure 2:
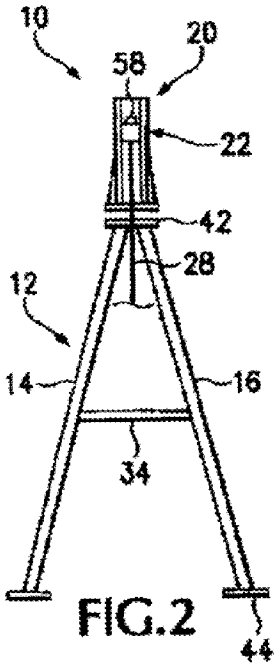
Figure 4:
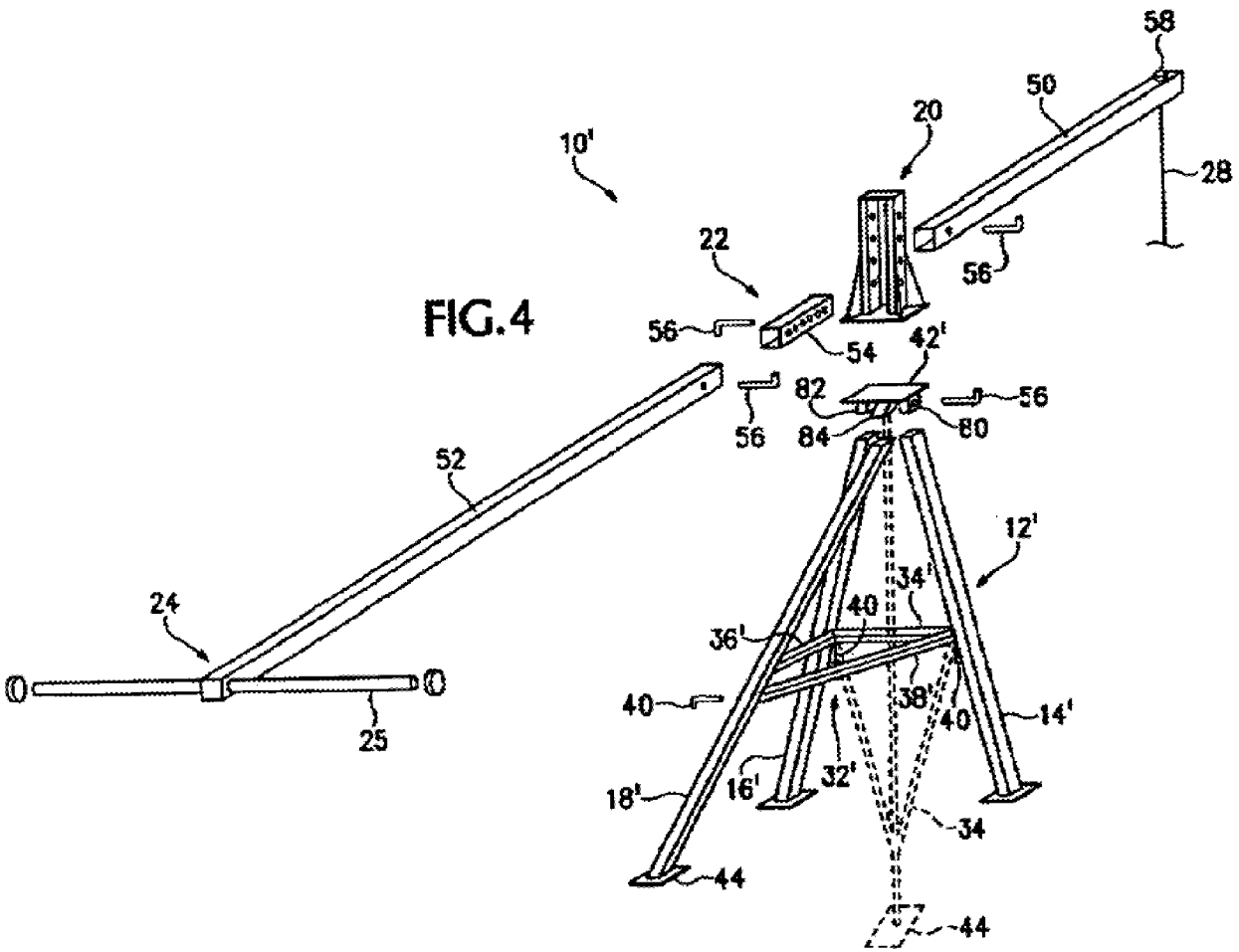
Figure 5:
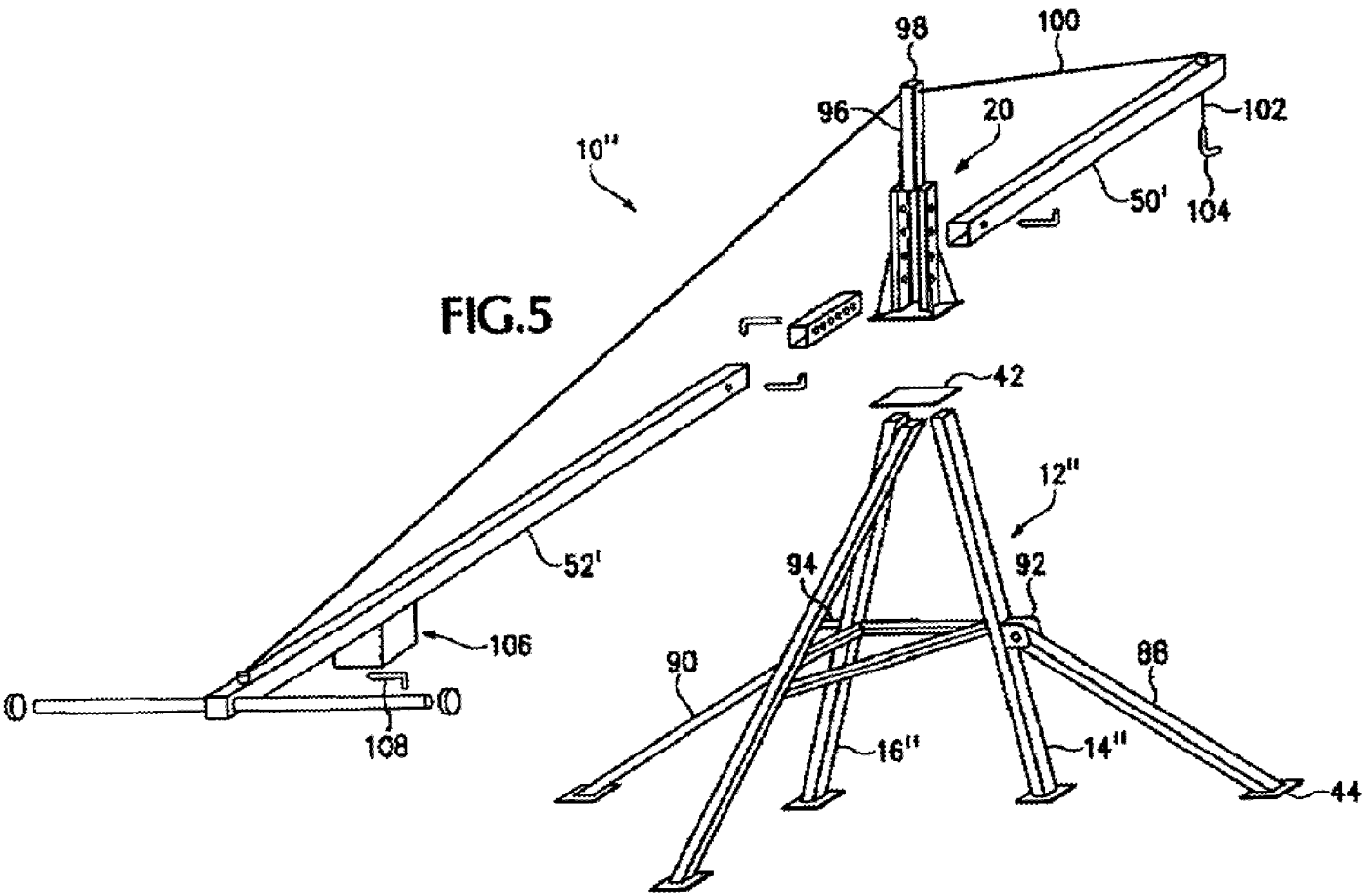
Figures 6, 7:
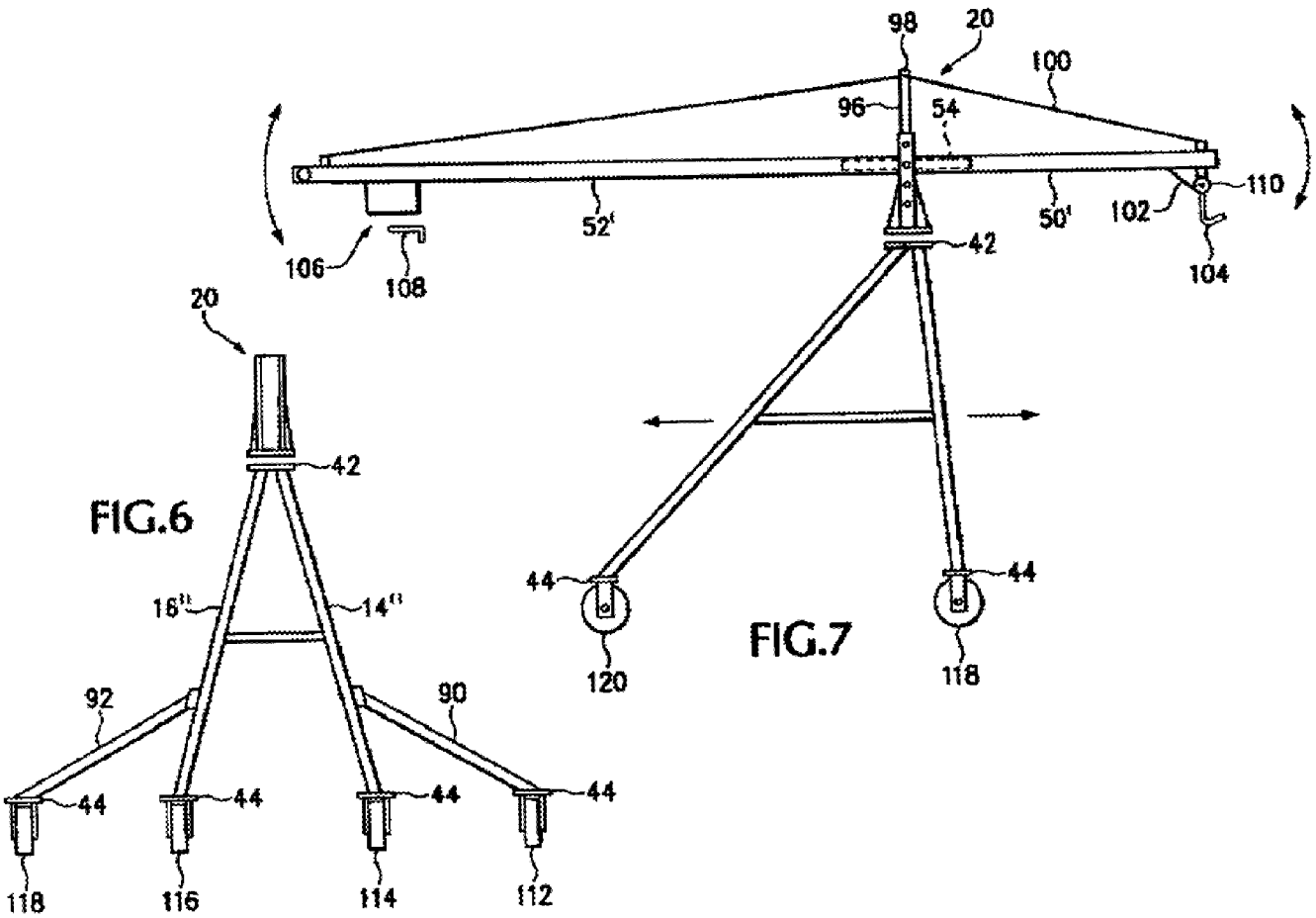
Figure 8:
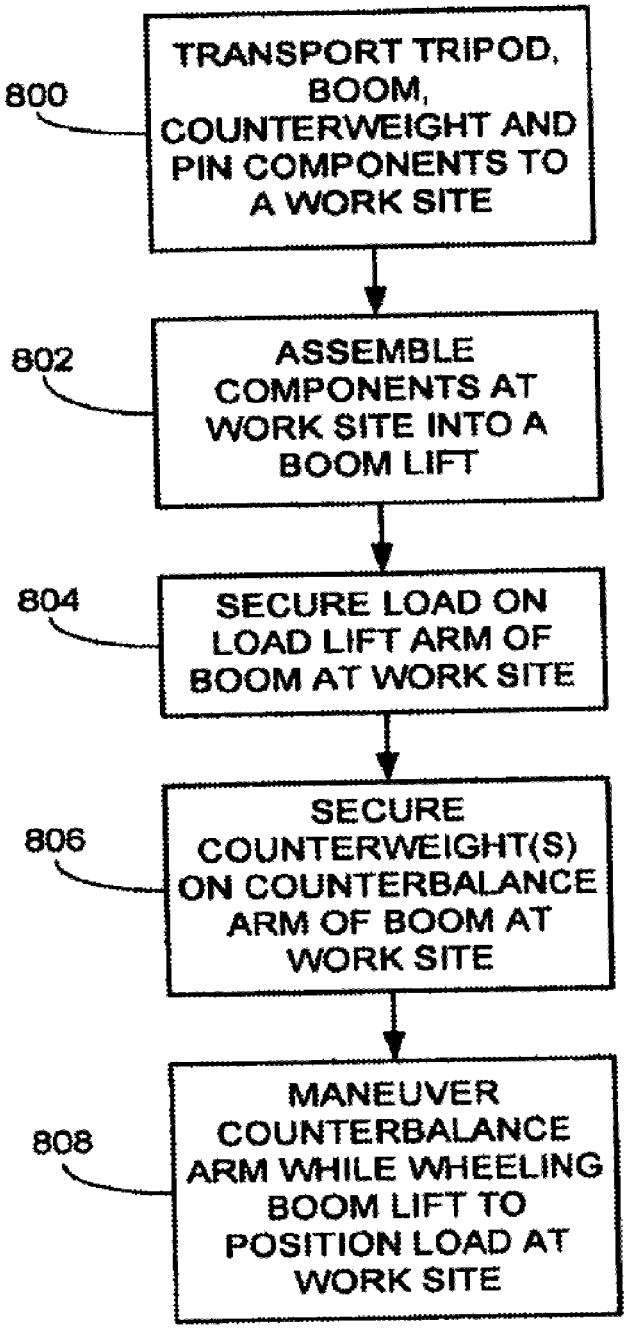

FIG. 8 is a flowchart illustrating the invented boom lift method of the invention.

DETAILED DESCRIPTION OF THE PREFERRED EMBODIMENTS

The invented method and apparatus provide a low-cost, manual, portable, lightweight boom lift that lends itself to rooftop installations, at elevations above the rooftop of up to approximately ten feet, of light-to-medium loads up to approximately 1000 pounds. The apparatus is assembled by pivotally pinning, e.g. with one or more cotter keys, various relatively lightweight members together on site (in situ) and to charge the counterweight arm end of the boom lift opposite the lift arm also on site, thus greatly facilitating maneuverability in transport, employment and deployment. The counterweights preferably are water-chargeable containers. The boom lift leverages its load by a simple 2:1 mechanically advantaged boom lift manipulation atop its tripod support legs-and-wheels arrangement. Neither hydraulic nor pneumatic nor power conduits are required for operation. The lightweight extruded square-tubular and die-cast aluminum and steel materials and simple structural geometries render the apparatus very low cost. The apparatus is structured for ready break-down and thus has a relatively small footprint in use and an even smaller footprint in transit to and from a work site. These and other advantages will be more apparent from the detailed discussion below.

FIG. 1 illustrates in isometric view the invented manual boom lift apparatus 10 in accordance with a first embodiment of the invention. Apparatus 10 includes a base 12 having three or more support legs 14, 16, 18. It further includes a fulcrum mechanism 20 configured to fixedly mount support legs 14, 16, 18 in a tripod configuration, as shown. Apparatus 10 further includes a boom member 22 detachably and pivotally mounted on fulcrum mechanism 20. Boom member 22 includes fore and aft respectively a counterweight arm 24 configured for detachably mounting one or more weights 26*b*, 26*c*, 26*d*, 26*e*, 26*f* (shown in phantom) and a lift arm 28 configured to hoist a load 30 (also shown in phantom). Those of skill in the art will appreciate that lift apparatus 10 enables lift and placement of the load by manual pivotal manipulation of boom member 22.

Base 12 further includes a generally triangular, hinged, pivotal brace mechanism 32 that includes three brace members 34, 36, 38; a snapper pin 40 for fixing it in place between support legs 14, 16, 18 and a generally square fulcrum base plate 42. Those of skill in the art will appreciate that support legs 14, 16, 18 are welded or otherwise durably and fixedly mounted to a lower surface of a tripod cap 42. At the base of each of support legs 14, 16, 18 is a generally square pad such as pad 44 for mounting a wheel, as will be described below by reference to FIGS. 6 and 7.

Fulcrum, or pivot/support, mechanism 20 will be described below in more detail by reference to detail A of FIG. 1. From FIG. 1, however, it may be seen to include a frame 46 defining a vertical rectangular channel 48 through which boom member 22 extends horizontally for pivotal mounting at a desired height within the channel. Those of skill in the art will appreciate that height adjustment and pivotal mounting of boom member 22 in fulcrum mechanism 20 is made possible by providing a vertical array of opposing through-hole pairs formed in the upright sidewalls of frame 46 as shown. Fulcrum mechanism 20 is fixedly and durably mounted atop tripod cap 42 as by seam or spot welding (the former being most preferred) or other suitable technique.

In accordance with one embodiment of the invention, boom member 22 includes three separate sections or components: A lift member 50 and a counterbalance member 52 receive in proximal ends thereof a pivot member 54, with each of the lift member 50 and counterbalance member 52 pinned to pivot member 54 through corresponding receiving holes and with pivot member 54 pinned at a desired height within frame 46. As will be better seen by reference below to Detail A, three hitch pins 56 are used to pin counterbalance member 50 to pivot member 54, lift member 52 to pivot member 54 and pivot member 54 to pivot frame 46. A load attachment mechanism 58 for securing load 30 is provided at a distal end of lift member 50, and a counterweight support member 25 is provided at a distal end of counterbalance member 52 for carrying one or more counterweights 26*a*, 26*b*, 26*c*, 26*d*, 26*e*, 26*f*. (Those of skill in the art will appreciate that, in accordance with one embodiment of the invention, counterweight support member 25 weighs approximately 30 pounds, thus effectively causing rearward counterbalance member 52 of boom 22 to pivot downwardly toward the support surface, e.g. a roof, when the boom is charged with neither load nor counterweight.)

Invented apparatus 10 in use is operated manually to lift and maneuver load 30 as desired by manually manipulating counterbalance member 52. Those of skill in the art will appreciate that a mechanical advantage of approximately 2:1 is obtained by a 2:1 length ratio between counterbalance member 52 and lift member 50. Moreover, load 30 is effectively counterbalanced by one or more counterweights 26*a*, 26*b*, 26*c*, 26*d*, 26*e*, 26*f* to facilitate maneuvering the load into proper position and orientation. More or fewer counterweights 26*a*, 26*b*, 26*c*, 26*d*, 26*e*, 26*f* can be used to roughly adjust the counterbalancing effect on variable loads. Also, by virtue of the novel construction of the counterweights themselves, very fine adjustment of counterbalancing effect is possible.

This is because, in accordance with one embodiment of the invention, the counterweights are ballast-filled containers to and from which ballast can be added or subtracted. Preferably, the counterweights are made of water-fillable, sealed containers that can be simply filled in situ (at the site where the apparatus is to be employed in lifting and positioning a load) and slid onto either side of counterweight support member 25, as shown in FIG. 1. Thus, in accordance with one embodiment of the invention, infinite adjustment of counterbalance effect can be achieved for delicate load handling tasks. Moreover, the lightweight portability of invented apparatus 10 is not compromised by the fixed weight of an integral counterweight. Instead, the containers can remain empty (and thus as light as air) while the boom lift apparatus is positioned at the installation site, e.g. on top of a roof, and then ballast, preferably liquid and most preferably water, can be introduced into the containers to a desired fill factor and corresponding weight.

Those of skill in the art will appreciate that six 6-gallon containers when filled with water (weighing approximately 8.3 pounds/gallon) would weigh approximately 300 pounds, which when added to the 30-pound weight of counterweight support arm 25 would provide adequate counterweight to an approximately 660 pound load. This is because of the 2:1 leverage obtained by use of the invented boom lift having a longer counterbalance arm and a shorter load lift arm, as described and illustrated herein. Importantly, smaller or larger loads are accommodated as well, by simply reducing or increasing the mass of the counterweights that are secured to counterweight support member 25 (the length of which may, within the spirit and scope of the invention, be decreased or increased to accommodate fewer or more containers). Those of skill in the art also will appreciate that alternative counterweight numbers and configurations are within the spirit and scope of the invention.

After use, the water or other ballast can be dumped or siphoned from the containers and the boom lift apparatus easily transported to the next work, e.g. HVAC/R installation, site.

Those of skill in the art will appreciate that the purpose of hinged brace 32 is to permit triangular brace members 34, 36, 38 to be moved out of the way for easy transport of invented apparatus 10. Those of skill will also appreciate that construction of boom mechanism 22 in sections similarly facilitates break down and reduces over dimension of invented apparatus 10 during transportation. Finally, those of skill in the art will appreciate that, in accordance with one embodiment of the invention, the bases of support legs 14, 16, 18 are equipped with wheels (not shown in FIG. 1) to facilitate positioning of invented apparatus 10 while it is in use, i.e. while a load is being positioned and oriented for installation. Thus, tripod base 12 of invented apparatus 10 provides a relatively wide and deep stance or footprint to stabilize loads while also facilitating smooth and effective load movement from one place to another. The wheels, which can be employed in any of the three embodiments described and illustrated herein, will be described in more detail below by reference to FIGS. 6 and 7.

Detail A illustrates in fragmentary detail isometric view fulcrum mechanism 20, load member 50 and lift member 52 as they are assembled in accordance with one embodiment of the invention. Fulcrum mechanism 20 will be understood to include frame 46 defining channel 48, as described above. Frame 46 may be seen to include a fulcrum base plate 60, left and right sidewalls 62, 64, left and right gusset pairs 66*a*, 66*b*, 68*a*, 68*b* and fulcrum cap 70. Left and right sidewalls 62, 64 are formed of opposing U-shaped angle members having their U-shaped openings facing outwardly, away from one another, as shown. Sidewalls 62, 64 have formed therein four sets of opposed through hole pairs 72, 74, 76, 78 spaced apart by approximately 4" and preferably evenly spaced along vertically extending sidewalls 62, 64 to permit height adjustment of boom mechanism 22 by selectively pinning pivot member 54 at a desired elevation within channel 48 by a hitch pin 56.

Those of skill in the art will appreciate that proximal ends of load member 50 and lift member 52 extend slidably around pivot member 54 on either end of pivot member 56 and are pinned in place with a pair of hitch pins 56. In accordance with one embodiment of the invention, there is a 4" gap between the proximal ends of load member 50 and lift member 52, so that pivot member 54 alone extends through channel 48 and so that load member 50 and lift member 52 extend respectively fore and aft of the channel. Preferably, hitch pins 56 are cotter key locked in place after they are installed, thereby to secure the affected assemblies. The same is true of snapper pin 40 in tripod base 12 (refer briefly back to FIG. 1). (Most preferably, each cotter key corresponding to a hitch pin or snapper pin is physically affixed to its respective pin, as is known, to prevent key loss.) It will be understood by those of skill in the art that more or fewer hole pairs may be provided, within the spirit and scope of the invention, having a greater or lesser gap therebetween. It will also be understood that the component parts of frame 46 preferably are welded, e.g. seam-welded (most preferably) or spot-welded. But those of skill in the art will appreciate that, within the spirit and scope of the invention, frame 46 may assume alternative forms made by alternative means, such as any suitably durable structure formed alternatively by one or more of extruding, machining or casting.

Any suitable materials and dimensions can be used in invented apparatus 10, and the following description of materials and dimensions used in accordance with one embodiment of the invention is intended to illustrate but not to limit the scope of the invention. For example, boom load and lift members 50, 52 preferably are of 2.5" square aluminum (hollow) tubing having 0.25" (¼") thick walls, with load member 50 being approximately 5' long and with lift member 52 being approximately 10' long. Pivot member 54 preferably is of 2" square milled steel tubing having ¼" thick walls, with pivot member 54 being approximately 18-24" long. Support legs 14, 16, 18 preferably are of 2" square aluminum tubing (radius corner) having ¼" thick walls, with legs 14, 16 being approximately 5' long and with leg 18 being approximately 82" long. (Those of skill in the art will appreciate that preferably the triangular base of the tripod that supports the fulcrum is nominally vertically aligned with the lateral center of mass of apparatus 10, there by to obtain maximum horizontal stability of invented apparatus 10.) Tripod cap 42 preferably is of 10" square flat aluminum having a thickness of ¼". Brace members 34, 36, 38 preferably are 1"×1" aluminum angle brackets having a thickness of ¼", with members 36, 38 being approximately 38" long and with member 34 being approximately 15.5" long.

Fulcrum base plate 60 is of 10" square flat steel having a thickness of ¼". Vertical sidewalls 62, 64 and gussets pairs 66*a*, 66*b*, 68*a*, 68*b* are also of flat steel having a thickness of ¼". Fulcrum cap 70 is of 5" square flat steel having a thickness of ¼". Those of skill in the art will appreciate that, in accordance with one embodiment of the invention, the component parts of fulcrum mechanism 20 are milled or otherwise formed steel, thus providing greater durability but slightly higher weight, whereas the remaining components of invented apparatus 10 in large part are formed of aluminum, providing adequate durability and lower weight. Nevertheless, it is contemplated as being within the spirit and scope of the invention that one or more suitable alternative materials for these component parts of the invented apparatus are within the spirit and scope of the invention.

In accordance with one embodiment of the invention, support leg base plates 44 are of 5" square flat aluminum having a thickness of ¼". Load member 25 is a 1" round Schedule 40 ends-threaded pipe and includes screw-on end caps. Hitch pins 56 are of an aluminum alloy 0.5" in diameter and 4.75" in length. Finally, snapper pin 40 is of an aluminum alloy 0.3125" (5/16") in diameter and 3.5" in length. As described above, preferably the hitch pins and the snapper pins are integrally (inseparably) equipped with secure, cotter-type key locks.

FIGS. 2 and 3 illustrate the first embodiment of the invention corresponding with FIG. 1, respectively in a front and side elevation. Briefly, FIGS. 2 and 3 respectively in front and side elevation show tripod support base 12 including front support legs 14, 16 (omitted from FIG. 2, for the sake of clarity, is rear support leg 18); counterweight arm 24 including elongate counterweight member 52; front brace member 34; fulcrum mechanism 20 including elongate pivot member 54; boom mechanism 22; lift mechanism 22; load attachment mechanism 58; and load arm 28 including elongate load member 50.

In accordance with the first embodiment of the invention described and illustrated herein, a load of up to approximately 500-1000 pounds readily can be lifted, positioned, oriented and placed. Moreover, such can be accomplished with only one or two operators, since the load is counterbalanced and leverage is increased in accordance with the invention. This capacity may, within the spirit and scope of the invention, be increased or decreased by dimensional scaling. It is contemplated as being within the spirit and scope of the invention to reinforce counterbalance member 52 (and/or lift member 50) along its substantial length by seam or spot welding (or otherwise affixing) a length of 1"×1" aluminum angle having a thickness of ¼" thereto. Such reinforcement, if deemed necessary or desirable, can be added to any of the embodiments of the invention as described and illustrated herein, and is within the spirit and scope of the invention.

FIG. 4 illustrates in isometric view the invented apparatus 10' in accordance with a second embodiment of the invention. Very briefly, it will be understood that this second embodiment of the invention features a boom lift assembly that is separable from the tripod base for ease of passage through small openings. Other structural and material aspects of the second embodiment are identical with those of the first embodiment and, for the sake of brevity, will not be described in detail.

FIG. 4 illustrates an alternative embodiment of the invention at 10'. All particulars of invented apparatus 10' are identical to those of invented device 10 described above, except that a detachable tripod cap 42' is provided atop modified support legs 14', 16', 18' and except that a triangular brace mechanism 32' is removably pinned to support legs 14', 16', 18. Those of skill in the art will appreciate that this alternative configuration achieves even better portability of invented apparatus 10', while retaining ease of assembly on site. Access through smaller openings can be obtained using invented apparatus 10' since all three support legs and the brace itself are easily removed during transportation and easily assembled for use.

Tripod cap 42' is equipped with square tubular extensions 80, 82, 84 onto which support legs 14', 16, 18' readily slide and are secured by the use of three cotter key-like locking hitch pins 56 (only one of which is shown, for the sake of clarity). Those of skill in the art will appreciate that tubular extensions 80, 82, 84 and support legs 14', 16', 18' are equipped with corresponding through holes (also not shown, for the sake of clarity) for pinning purposes. Brace mechanism 32' includes fixed brace member 34' having through holes (also not shown) formed therein and removable brace members 36', 38' also having through holes formed therein on either end thereof to receive three corresponding snapper pins 40 for quick and easy assembly and employment of invented apparatus 10' on site. Thus it will be appreciated by those of skill in the art that triangularly configured support legs 14', 16' fixed by brace member 34' can readily be fitted through a smaller opening with third support leg 18' and corresponding brace members 36', 38' and tripod cap 42' removed. Thus the 'transport footprint' of invented apparatus 10' is reduced to facilitate transportation without significant negative impact on ease of assembly on site.

FIG. 5 illustrates in isometric view the invented apparatus 10" in accordance with a third embodiment of the invention. Very briefly, it will be understood that this third embodiment of the invention features an optional outrigger mechanism associated with the base and optional cable truss and crank lift mechanisms associated with the boom. Other structural and material aspects of the third embodiment are identical with those of the first and second embodiment and, for the sake of brevity, will not be described in detail.

Apparatus 10" includes an outrigger mechanism indicated generally at 86, the outrigger mechanism including two laterally opposed outrigger legs 88, 90 that, while selectively widen the footprint and thus increase the stability of the boom lift. Those of skill in the art will appreciate that support legs 14" and 16" are equipped in accordance with this embodiment of the invention with mounting brackets 92, 94 that pivotally mount outrigger legs 88, 90 so that when employed the outrigger legs extend outwardly but generally within the plane formed by support legs 14", 16", as shown. Those of skill will appreciate that pivotable outrigger legs 88, 90 permit tripod base 12" to be easily transported with a reduced footprint by pivoting the outrigger legs into generally axial alignment with their corresponding support legs. Those of skill also will appreciate that, within the spirit and scope of the invention, the outrigger legs can be removably, rather than fixedly, attached to the mounting brackets, as by pivotally pinning with a pair of hitch pins. Finally, those of skill in the art will appreciate that outrigger legs 88, 90 and mounting brackets 92, 94 preferably are made of any suitably durable material, e.g. ¼" tubular and/or angular aluminum.

Those of skill will appreciate that, not shown in FIG. 5, for the sake of clarity, are wheels on pads 44 provided on the bases of support legs 14", 16" and outrigger legs 88, 90. Those of skill also will appreciate that FIG. 5 shows fixedly mounted tripod cap 42 rather than detachably mounted tripod cap 42', although within the spirit and scope of the invention either can be employed with invented apparatus 10". Apparatus 10" also includes a square tubular steel member 96 atop fulcrum mechanism 20, member 96 extending upwardly from and mounted on fulcrum cap 70. Member 96 includes a cable eyelet 98 at its upper reach to accommodate a cable 100 extending therethrough. Cable 100 under predetermined tension extends through eyelet 98, with a fore end thereof pinned to load lift member 50' and with an aft end thereof pinned to counterbalance member 52', as shown. Those of skill in the art will appreciate that member 96, cable 100, load lift member 50' and counterbalance member 52' thus form a cable bow truss to stabilize and support the ends of beam member 22 and to provide added lift capability of invented apparatus 10".

A forward end of a second cable 102 is provided with a load hook 104 and a rearward end of cable 102 is wound around a spindle (not visible in FIG. 5) that forms part of a crank mechanism 106 having a manual crank handle 108. The substantial length of cable 102 will be understood to extend through counterbalance, pivot and load lift arms 52', 54' and 50', and to exit load lift arm 50' near its distal end through a guide mechanism, e.g. an eyelet, 110. Those of skill in the art will appreciate that the hook 104 end of cable 203 can be alternately spooled out and in to reach and secure a load (not shown in FIG. 5). In other words, the nominal elevation of hook 104 can be adjusted relative to the distal end of load lift member 50' by manually operating crank mechanism 106 by turning crank handle 108, thereby facilitating a load's secure attachment.

FIGS. 6 and 7 illustrate the third embodiment of the invention shown in FIG. 5 in a front and side elevation, respectively, and also show the wheels that, within the spirit and scope of the invention in all of its illustrated embodiments, preferably are included for the purpose of mobility. It can be seen from FIG. 6 that preferably all support and outrigger legs, whether three or five in number (only four of which are shown in FIG. 6 for the sake of clarity, with the fifth wheel being shown only in FIG. 7), are equipped with wheel mechanisms (designated 112, 114, 116, 118, 120 in FIGS. 6 and 7). The lateral distance between each lateral wheel mechanism and its corresponding outrigger wheel mechanism is preferably approximately 30". In accordance with the wheeled embodiment(s) of the invention, the wheel mechanisms are seam or spot welded or otherwise affixed to pads 44 so that their pneumatic tires freely turn.

Those of skill in the art will appreciate from FIG. 7 that invented apparatus 10, 10', 10" in any of its various embodiments, of which the embodiment in FIG. 7 is typical, provides a boom lift that is pivotal, as indicated by curved arrows. It will also be appreciated that the invented apparatus also provides for wheeled movement that is fore and aft, as indicated by straight arrows. These two movements facilitate on site (in situ) securement, lift, positioning, orientation and placement of a substantial load.

FIG. 8 is a flowchart that illustrates the invented boom lift method in accordance with another embodiment of the invention. The boom lift method will be understood to include a) transporting to a work site separate components including a tripod having a fulcrum at its apex and wheels at its base, a boom having a counterbalance arm and a load lift arm, one or more counterweights and one or more pins (block 800); assembling the separate components at the work site using the one or more pins to join the components into an assembled boom lift, said assembling including pivotally mounting the boom member on the fulcrum of the tripod (block 802); securing a load on a load lift end of the boom at the work site (block 804); securing the one or more counterweights on a counterbalance arm of the boom member at the work site (block 806); and manually maneuvering the counterbalance arm while wheeling the boom lift to position the load at the work site (block 808). Those of skill in the art will appreciate that alternative methods of using the invented boom lift apparatus are contemplated and are within the spirit and scope of the invention.

In brief summary, the advantages of the invention are many. The invention provides a simple but elegant solution to roof-top or other hard-to-reach work sites where installations of modestly heavy loads is required. It does so by configuring a boom lift in discrete, lightweight component parts that are readily transported to the work site even through narrow openings such as windows, doorways, stairways, etc. due of their narrow span when so broken down. Yet the boom lift assembles quickly using easily hitched pins to join the component parts on site into a durable boom lift configuration. Importantly, the boom lift provides mechanical advantage of leverage by the disparate lengths of its load lift arm and counterbalance arm. Also importantly, the counterbalance arm is counterweighted on site by the simple provision of a preferably ubiquitous liquid ballast such as water easily introduced into one or more sealable containers. The boom lift is just as easily disassembled, therefore, after use.

Accordingly, while the present invention has been shown and described with reference to the foregoing embodiments of the invented apparatus and method, it will be apparent to those skilled in the art that other changes in form and detail may be made therein without departing from the spirit and scope of the invention as defined in the appended claims.

We claim:

1. Portable boom lift apparatus comprising:

a base having three or more support legs;

a fulcrum mechanism configured to mount on said base;

an elongate boom member detachably mounted on said fulcrum mechanism, said boom member including on one end thereof an elongate counterbalance arm configured for detachably mounting one or more weights, said boom member further including on the other end thereof an elongate lift ann configured for hoisting a load, said elongate boom member further including, intermediate and shorter relative to at least one of said elongate counterbalance arm and said elongate lift arm, a pivot member for pivotal engagement with said fulcrum mechanism, the fulcrum mechanism being configured with a plurality of opposing aligned holes for height adjustment of the pivot member relative to the fulcrum mechanism and corresponding opposing aligned holes provided through the pivot member to receive a slidingly inserted height-securing pin, a proximal end of said counterbalance arm and a distal end of said pivot arm being telescopically arranged with one coaxially sliding within the other and pinned together with pins slidingly inserted for quick but secure attachment and detachment, a proximal end of said lift arm and a distal end of said pivot arm also being telescopically arranged with one coaxially sliding within the other and pinned together with pins slidingly inserted for quick but secure attachment and detachment;

said portable boom lift apparatus enabling lift and placement of the load by manual pivotal manipulation of said boom member.

2. The apparatus of claim 1, wherein said pivot member is detachably mounted on said fulcrum mechanism by attachment means including one or more pins.

3. The apparatus of claim 1, wherein said elongate counterbalance arm and said elongate lift arm extend respectively aft and fore of said fulcrum mechanism.

4. The apparatus of claim 1, wherein said counterbalance arm mounts one or more weights each including a ballast-fillable container slidable onto a cross member operatively connected to said counterbalance arm.

5. The apparatus of claim 4, wherein each of said containers is configured to be at least partly filled with water.

6. The apparatus of claim 1, wherein at least one of said support legs is pivotally attached to said base relative to at least another of said support legs attached to said base in such manner that the pivotally attached leg can be pivoted into approximate planar alignment with others of said legs, thereby to reduce the span between distal ends of said at least one and said others of said support legs.

7. The apparatus of claim 1, wherein said base further includes a brace mechanism partway up said support legs, said brace mechanism including a brace configured to fix said support legs relative to one another in an upright position generally describing a cone the apex of which is near the elevated intersection of the axes of the support legs.

8. The apparatus of claim 7, wherein said brace mechanism includes a hinge mechanism for pivotally mounting said brace to two of said support legs and a pivotal pinning mechanism for attaching said brace to said one or more others of said support legs.

9. The apparatus of claim 1, wherein said fulcrum mechanism is configured to permit height adjustment of said pivot member relative to said base.

10. The apparatus of claim 1 which further comprises:

a cable crank mechanism including a cable having a book on a distal end thereof and a crank having a spindle mounting a handle for winding said cable, said cable extending through said boom member and exiting said boom member near a distal end of said lift arm to provide for spooling out and spooling in of said cable to a desired elevation of said hook.

11. The apparatus of claim 1 which further comprises:

a cable truss mechanism including a cable extending from a distal region of said counterbalance arm over an upright member extending from said fulcrum mechanism to a distal region of said lift arm, said cable under tension supporting and stabilizing said boom member.

12. The apparatus of claim 1, wherein said support legs of said base include wheels to facilitate movement of said lift apparatus.

13. The apparatus of claim 1, wherein said support legs of said base include at least two inner legs extending laterally outwardly from said boom member and further include at least two outrigger legs extending laterally beyond said at least two inner legs.

14. Portable boom lift apparatus comprising:

a base having three support legs;

a fulcrum mechanism configured to fixedly mount on said base; and an elongate boom member detachably mounted at an adjustable height on said fulcrum mechanism, said boom member including a pivot member pivotally attached to said fulcrum mechanism by a lockable pin inserted through corresponding aligned holes formed through opposing vertical support members of the fulcrum mechanism and through opposing walls of the pivot member, a first separable elongate load lift arm configured for hoisting a load and a second separable elongate counterbalance arm configured for counterbalancing the load, wherein said pivot member, said load lift arm and said counterbalance arm are formed of square tubular material, wherein proximal ends of said load lift arm and said counterbalance arm and opposing distal ends of said pivot arm are configured to be fitted within and around one another by a coaxial sliding action and to be fixed in such fitted relationship by slidingly inserting lockable pins through aligned holes formed in walls thereof, and wherein said boom member when mounted on said fulcrum mechanism is manually pivotable relative thereto at least in a vertical plane to lift a counterbalanced load thereby by manual manipulation of said boom member.

15. The apparatus of claim 14, wherein one of said three legs of said base is detachably or pivotably mounted to said base by inserting lockable pins through aligned holes formed therein, whereby a transport footprint of the apparatus is reduced by detachment or pivoting of said one leg for improved portability.

16. The apparatus of claim 15, said base further having a brace mechanism for fixing a triangular arrangement of said three support legs into a tripod, said brace mechanism being hinged to pivot generally into a plane formed by other two of said three legs.

17. The apparatus of claim 16 which further comprises:

at least three wheels mounted on said base near distal ends of said three support legs, said wheels enabling the apparatus to be manually wheeled from one place to another while lifting a counterbalanced load.

18. The apparatus of claim 17, wherein said counterbalance arm has coupled to a distal end thereof a counterweight arm for slidably securing thereon one or more containers at least partly fillable with ballast.

19. The apparatus of claim 18 which further comprises;

a cable truss mechanism including a cable extending from a distal region of said counterbalance arm over an upright member extending from said fulcrum mechanism to a distal region of said lift arm, said cable under tension supporting and stabilizing said boom member.

20. Portable boom lift apparatus comprising:

a tripod base having three braced support legs equipped with three wheels for rolling engagement with a support surface;

a fulcrum mechanism configured to fixedly mount atop said tripod base, and further configured with opposing vertically extended members each having a plurality of aligned opposing holes formed therein; and an elongate boom member detachably mounted at an adjustable height on and positioned between the vertically extended members of said fulcrum mechanism, said boom member including a pivot member pivotally attached to said fulcrum mechanism by a pin slidingly inserted through opposing aligned holes formed in walls of the pivot member and also through opposing aligned holes of the fulcrum mechanism, a separable elongate load lift arm configured for hoisting a load and a separable elongate counterbalance arm configured for counterbalancing the load, wherein said pivot member, said load lift arm and said counterbalance arm are formed of square tubular material, wherein proximal ends of said load lift arm and said counterbalance arm and opposing distal ends of said pivot arm are configured to be slidingly fitted within and around one another and to be fixed in such fitted relationship by slidingly inserting lockable pins through aligned holes formed in walls thereof, wherein said counterbalance arm mounts a counterweight arm thereon, the counterweight arm configured to mount thereon a counterweight in the form of one or more containers at least partly filled with ballast, and wherein said boom member when mounted on said fulcrum mechanism is configured to nominally balance a load suspended from its load lift ann and a counterweight mounted an its counterweight arm and is manually pivotable relative to the fulcrum mechanism in a vertical plane to lift a counterbalanced load by manual manipulation of said boom member and is manually movable in a horizontal plane by manipulation of said boom member to move the counterbalanced load across the support surface by rolling engagement therewith of the wheels.

21. The apparatus of claim 1, wherein the lift arm is configured to hoist a load of at least 500 pounds.

22. The apparatus of claim 1, wherein the fulcrum mechanism is configured to confine movement of the pivot arm within a single plane relative to the fulcrum mechanism.

* * * * *

UNITED STATES PATENT AND TRADEMARK OFFICE

CERTIFICATE OF CORRECTION

PATENT NO. : 7,293,668 B2
APPLICATION NO. : 11/048684
DATED : November 13, 2007
INVENTOR(S) : Brossart et al.

It is certified that error appears in the above-identified patent and that said Letters Patent is hereby corrected as shown below:

PLEASE ADD DRAWING SHEET 7 CONSISTING OF DETAIL A AS SHOWN ON THE ATTACHED PAGE.

Signed and Sealed this

Eighth Day of April, 2008

JON W. DUDAS
*Director of the United States Patent and Trademark Office*

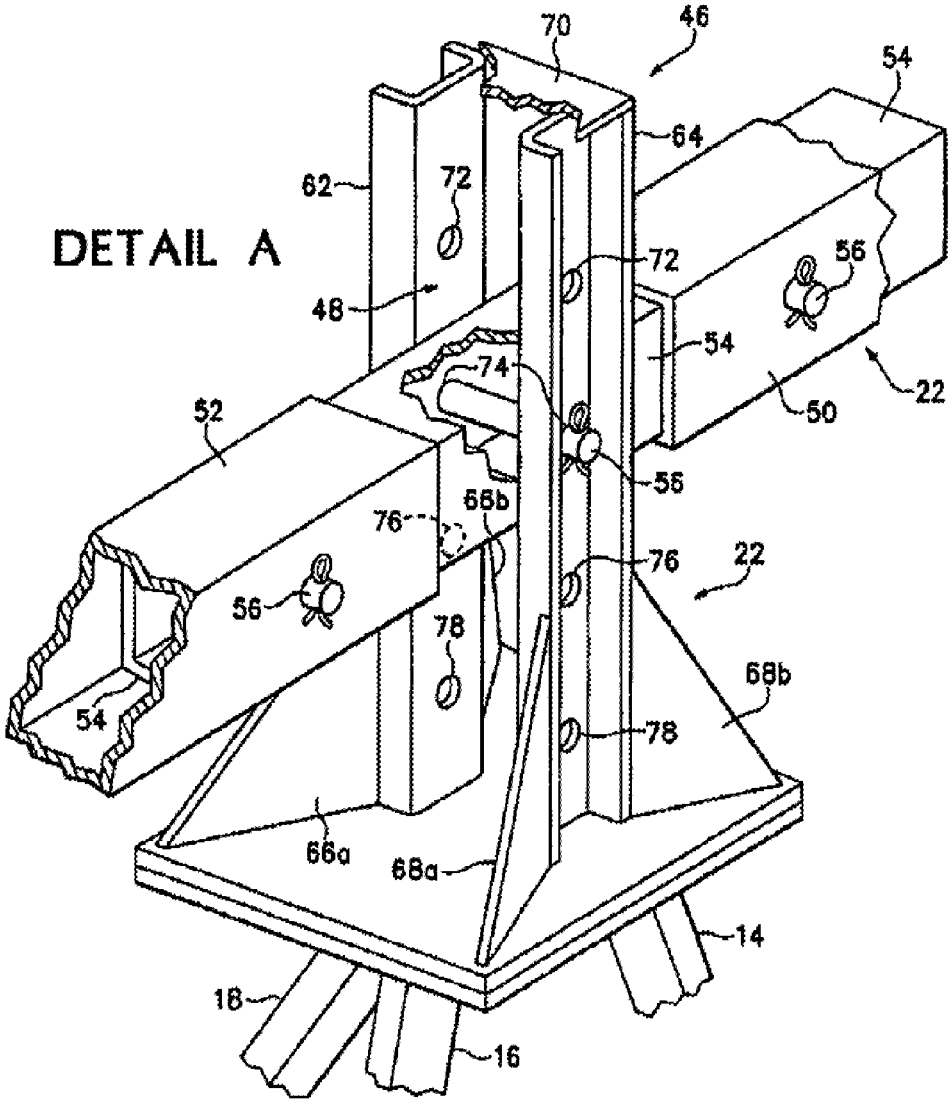
DETAIL A
70
46
54
64
62
72
72
56
48
54
74
22
52
50
56
76
66b
76
22
56
78
68b
54
78
66a
68a
14
18
16

UNITED STATES PATENT AND TRADEMARK OFFICE

CERTIFICATE OF CORRECTION

PATENT NO. : 7,293,668 B2
APPLICATION NO. : 11/048684
DATED : November 13, 2007
INVENTOR(S) : Brossart et al.

It is certified that error appears in the above-identified patent and that said Letters Patent is hereby corrected as shown below:

Delete the title page and substitute therefor the attached title page.

PLEASE ADD DRAWING SHEET 7 CONSISTING OF DETAIL A AS SHOWN ON THE ATTACHED PAGE.

Delete Drawing Sheets 1-6 and substitute therefor the attached Drawing Sheets 1-7.

This certificate supersedes the Certificate of Correction issued April 8, 2008.

Signed and Sealed this

Sixth Day of May, 2008

JON W. DUDAS
*Director of the United States Patent and Trademark Office*

(12) United States Patent
Brossart et al.

(10) Patent No.: US 7,293,668 B2
(45) Date of Patent: Nov. 13, 2007

(54) MANUAL BOOM LIFT METHOD AND APPARATUS

(75) Inventors: Ray Brossart, Portland, OR (US); Dave Trammel, Clackamas, OR (US); Ken Klunder, Oregon City, OR (US)

(73) Assignee: KDR, LLC, Clackamas, OR (US)

( * ) Notice: Subject to any disclaimer, the term of this patent is extended or adjusted under 35 U.S.C. 154(b) by 1 day.

(21) Appl. No.: 11/048,684

(22) Filed: Feb. 1, 2005

(65) Prior Publication Data

US 2006/0169661 A1 Aug. 3, 2006

(51) Int. Cl.
*B66C 23/26* (2006.01)

(52) U.S. Cl. ..... 212/177; 212/175; 212/179

(58) Field of Classification Search ..... 212/195, 212/241, 249, 263, 175, 177, 179
See application file for complete search history.

(56) References Cited

U.S. PATENT DOCUMENTS

| | | | | | |
|---|---|---|---|---|---|
| 25,494 | A | * | 9/1859 | Duchamp | 212/263 |
| 514,355 | A | * | 2/1894 | French | 212/241 |
| 709,506 | A | * | 9/1902 | Packer | 212/241 |
| 1,316,181 | A | * | 9/1919 | Phares | 212/195 |
| 1,345,008 | A | * | 6/1920 | Hill | 212/177 |
| 2,377,758 | A | * | 6/1945 | Cohen | 212/179 |
| 3,240,353 | A | * | 3/1966 | Leavesley | 212/279 |
| 3,268,092 | A | * | 8/1966 | Hainer et al. | 414/729 |
| 4,004,778 | A | * | 1/1977 | Steinhagen | 212/294 |
| 4,310,098 | A | * | 1/1982 | Dirksen | 212/299 |
| 4,671,478 | A | * | 6/1987 | Schoenig et al. | 248/124.1 |
| 4,849,778 | A | * | 7/1989 | Samuelson | 396/428 |
| 6,375,145 | B1 | * | 4/2002 | Payne | 248/500 |
| 6,416,418 | B1 | * | 7/2002 | Kleimeyer | 472/118 |
| 6,478,427 | B1 | * | 11/2002 | Morris et al. | 352/243 |
| 6,705,773 | B2 | * | 3/2004 | Fix | 396/419 |
| 6,910,846 | B1 | * | 6/2005 | Doeden | 414/589 |
| 7,062,962 | B2 | * | 6/2006 | Pasternack et al. | 73/170.29 |
| 2006/0043041 | A1 | * | 3/2006 | Lopes | 212/175 |

OTHER PUBLICATIONS

Definition of the Term "Telescopic" From ANSWERS.COM Web Page; Page Dated Jun. 7, 2007.*

* cited by examiner

*Primary Examiner*—Thomas J. Brahan
(74) *Attorney, Agent, or Firm*—Ater Wynne LLP

(57) ABSTRACT

Manual boom lift apparatus and method involve a base having three support legs, a fulcrum configured to fixedly mount the legs, a boom member detachably mounted on the fulcrum, the boom member including on either end a counterbalance arm configured for detachably mounting one or more counterweights and a lift arm configured for hoisting a load, the lift apparatus enabling lift and placement of the load by pivotal manipulation of the boom member. Assembly of the detachable boom lift apparatus components is performed on the work site (in situ) and involves removably pinning aligned hole pairs to join the components and filling one or more containers with ballast to act as counterweights to the hoisted load. The apparatus is lightweight and durable, is easy to transport through small openings and can be used in rooftop installations of heating, ventilation, air conditioning and refrigeration (HVAC/R) equipment.

22 Claims, 7 Drawing Sheets

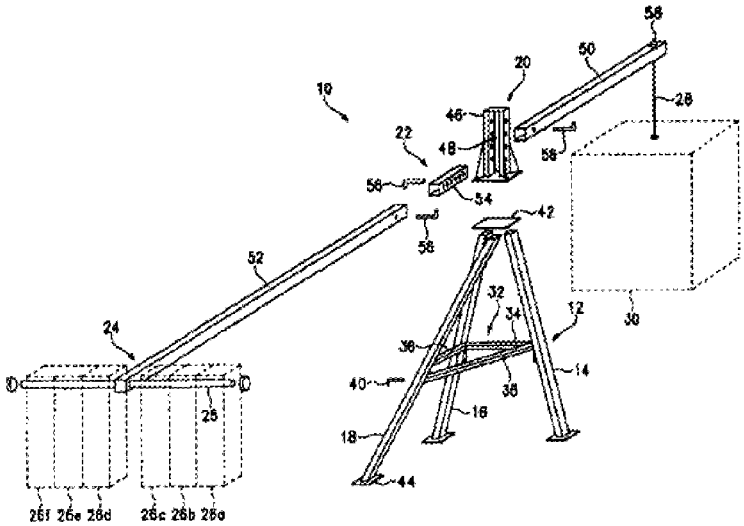

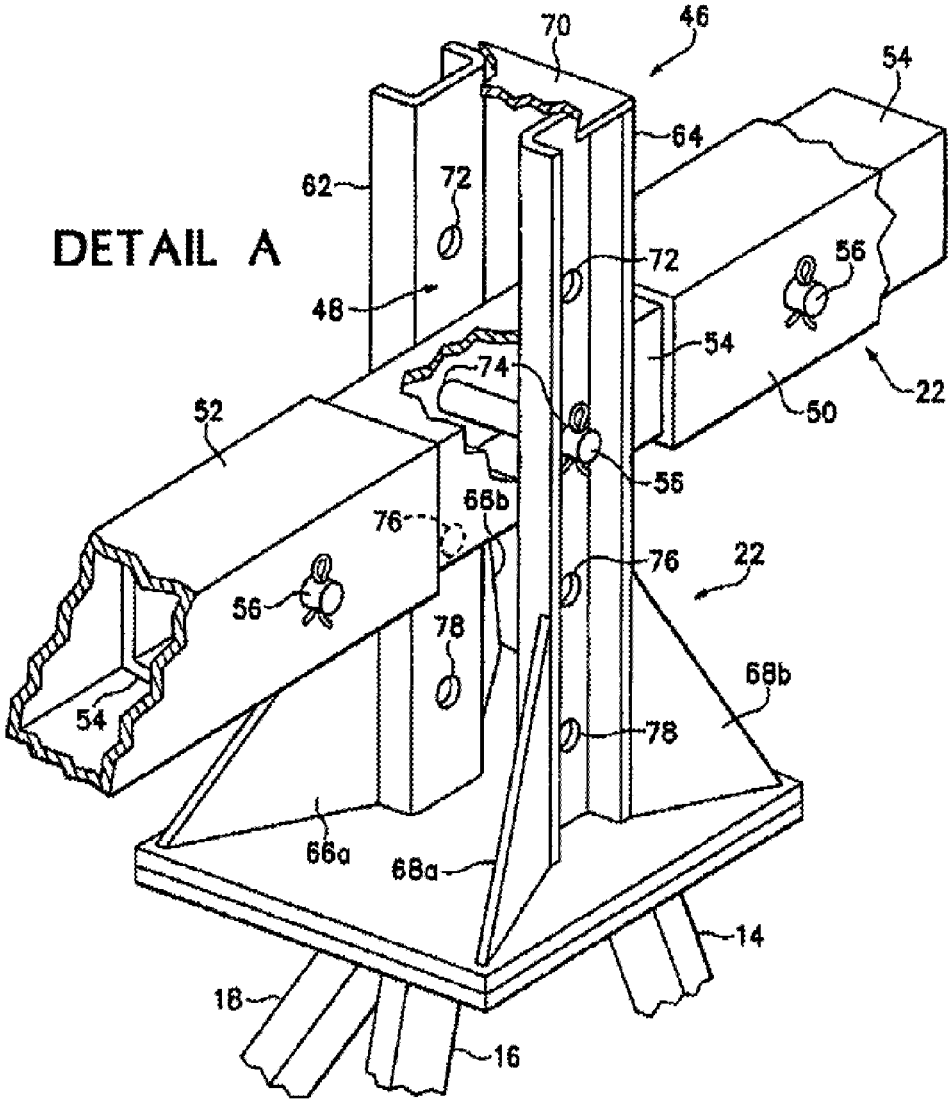
DETAIL A
70
46
54
64
62
72
72
56
48
54
74
22
50
52
56
66b
76
76
22
56
78
68b
54
78
66a
68a
14
18
16

UNITED STATES PATENT AND TRADEMARK OFFICE

CERTIFICATE OF CORRECTION

PATENT NO. : 7,293,668 B2
APPLICATION NO. : 11/048684
DATED : November 13, 2007
INVENTOR(S) : Ray Brossart, Dave Trammel and Ken Klunder It is certified that error appears in the above-identified patent and that said Letters Patent is hereby corrected as shown below:

Column 9, line 22, “lift ann” should be changed to --lift arm--.

Column 10, line 13, “book” should be changed to --hook--.

Column 12, line 22, “lift ann” should be changed to --lift arm--; line 23 “mounted an” should be changed to --mounted on--.

Signed and Sealed this

Twentieth Day of May, 2008

JON W. DUDAS
*Director of the United States Patent and Trademark Office*